US006400916B1

(12) United States Patent
Go et al.

(10) Patent No.: US 6,400,916 B1
(45) Date of Patent: Jun. 4, 2002

(54) PROCESS CARTRIDGE AND ELECTROPHOTOGRAPHIC APPARATUS

(75) Inventors: Shintetsu Go, Yokohama; Tomohiro Kimura, Kawasaki; Yoichi Kawamorita, Chigasaki; Hideaki Nagasaka, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/448,446

(22) Filed: Nov. 24, 1999

(30) Foreign Application Priority Data

Nov. 30, 1998 (JP) ..... 10-339734

(51) Int. Cl.[7] ..... G03G 21/16

(52) U.S. Cl. ..... 399/111; 399/116; 430/60

(58) Field of Search ..... 399/111, 115, 399/116, 159, 161, 168, 174, 176, 279, 280; 430/60, 65, 131, 263; 492/48, 53

(56) References Cited

U.S. PATENT DOCUMENTS 4,751,167 A * 6/1988 Yamagata et al. ..... 430/263
5,162,185 A * 11/1992 Fukuda et al. ..... 430/60
5,875,375 A 2/1999 Ohmori et al. ..... 399/159
5,907,750 A * 5/1999 Yamada et al. ..... 399/116
5,908,725 A * 6/1999 Ueda ..... 430/65
5,991,571 A 11/1999 Yamada et al. ..... 399/117
6,004,669 A * 12/1999 Rokutan et al. ..... 399/116 X

FOREIGN PATENT DOCUMENTS

| | | | |
|---|---|---|---|
| JP | 57-29051 | | 2/1982 |
| JP | 57-62056 | | 4/1982 |
| JP | 58-12733 | | 1/1983 |
| JP | 58-14841 | | 1/1983 |
| JP | 64-29852 | | 1/1989 |
| JP | 04-125646 | * | 4/1992 |
| JP | 05-34964 | | 2/1993 |
| JP | 07-98534 | | 4/1995 |
| JP | 07-114249 | | 5/1995 |

* cited by examiner

*Primary Examiner*—Arthur T. Grimloy
*Assistant Examiner*—Hoan Tran
(74) *Attorney, Agent, or Firm*—Fitzpatrick, Cella, Harper & Scinto

(57) ABSTRACT

A process cartridge or an electrophotographic apparatus includes an electrophotographic photosensitive member and a charging member for charging the electrophotographic photosensitive member by application of a voltage, the charging member being in contact with the electrophotographic photosensitive member. The electrophotographic photosensitive member includes an aluminum substrate and a photosensitive layer provided thereon. The outermost surface of the substrate contains aluminum, oxygen, and at least one of titanium and zirconium.

14 Claims, 1 Drawing Sheet

PROCESS CARTRIDGE AND ELECTROPHOTOGRAPHIC APPARATUS

BACKGROUND OF THE INVENTION

1. Field of the Invention

The present invention relates to a process cartridge and an electrophotographic apparatus having a specific electrophotographic photosensitive member and a specific charging member.

2. Description of the Related Art

Charging means, which have been conventionally used for electrophotographic apparatuses, such as copying machines and laser beam printers, use corona charging and direct contact charging of a photosensitive member surface using a roller or a brush. Corona charging has several problems, such as the generation of ozone due to atmospheric discharge, high electrical facility costs due to the use of a high-voltage power source, and contamination of wiring due to corona discharge products. A proposed charging means for solving such problems is a contact charging means in which a charging member, such as a roller or brush, is brought into direct contact with a photosensitive layer surface and a voltage is applied to the charging member to charge the photosensitive member, as disclosed in, for example, Japanese Patent Application Laid-Open Nos. 7-114249 and 7-98534.

An electrophotographic photosensitive member generally includes a substrate and a photosensitive layer provided thereon for forming a latent image by charge or exposure. Fundamental requirements for the electrophotographic photosensitive member are sensitivity, and electrical and optical characteristics responsible for an applied electrophotographic process. Another requirement is environmental stability so that the electrophotographic photosensitive member sufficiently demonstrates the above characteristics in any environment from low temperature and low humidity to high temperature and high humidity.

Typical image defects include lines, black dots in blanks, white dots in black backgrounds, and fogging in blanks. Furthermore, fringes will occur due to the surface shape of the substrate and the uneven thickness of the photosensitive member in a digital copying machine or a laser beam printer using a light source having a single wavelength for exposure. Thus, countermeasures for avoiding the image defects are required in the production of the photosensitive members.

Major factors causing the image defects include foreign materials on the substrate, chemical impurities, such as contaminant elements contained in aluminum, and flaws such as flashes and pinholes on the substrate surfaces. In contact charging means, these chemical impurities and mechanical defects readily cause electrical leakage, and unsuccessful charge and image defects are significantly noticeable compared to corona charging.

A proposed configuration to prevent electrical leakage provides an intermediate layer, composed of an organic polymer, having an electrical blocking effect or containing metal oxide dispersed therein. Japanese Patent Application Laid-Open No. 5-34964 discloses the providing of an aluminum oxide layer by anodic oxidation of an aluminum substrate surface. Other surface oxidation techniques for aluminum substrates are, for example, the formation of chromate films, as disclosed in Japanese Patent Application Laid-Open Nos. 58-12733 and 57-62056; the formation of boehmite films, as disclosed in Japanese Patent Application Laid-Open Nos. 58-14841 and 64-29852; and the formation of oxide films by forced oxidation at high temperatures, as disclosed in Japanese Patent Application Laid-Open No. 57-29051.

In anodic oxidation, however, the thickness of the oxide film on the substrate must be at least 5 to 6 $\mu$m in order to form a uniform film, although this method can solve the above problems. Such a large thickness causes an increased residual potential and decreased sensitivity, in addition to increased process and material costs.

In the chromation process, it is significantly difficult to dispose the waste solution containing chromium in an environmentally safe way, in spite of the relatively satisfactory characteristics of the substrate.

In the boehmite treatment, the crystalline state of the resulting surface is not necessarily suitable for a substrate for electrophotographic photosensitive members, and thus satisfactory images are not obtainable.

SUMMARY OF THE INVENTION

Accordingly, it is an object of the present invention to provide a process cartridge and an electrophotographic apparatus which can prevent the formation of image defects in any environment, from low temperature and low humidity to high temperature and high humidity, even when a contact charging means is used as a charging means.

As a result of investigations for solving the above-discussed problems, a significantly effective means to prevent image defects in a contact charging means was discovered by using an electrophotographic photosensitive member which has an insoluble film having a specific composition provided on a substrate. The film is formed by a specific chemical treatment of the surface of the aluminum substrate used for the electrophotographic photosensitive member, that is, by a chemical reaction of the substrate with an acidic aqueous solution containing a specific metallic element without using electrical force.

According to a first aspect of the present invention, a process cartridge includes an electrophotographic photosensitive member and a charging member for charging the electrophotographic photosensitive member by the application of a voltage, the charging member being in contact with the electrophotographic photosensitive member, the electrophotographic photosensitive member and the charging member being integrally supported and being mountable to and detachable from an electrophotographic apparatus body. The electrophotographic photosensitive member includes an aluminum substrate and a photosensitive layer provided thereon, the outermost surface of the substrate containing the elements of aluminum, oxygen, and at least one of titanium and zirconium.

According to a second aspect of the present invention, an electrophotographic apparatus includes an electrophotographic photosensitive member, a charging member for charging the electrophotographic photosensitive member by the application of a voltage, the charging member being in contact with the electrophotographic photosensitive member, an exposure means, a developing means, and a transfer means. The electrophotographic photosensitive member includes an aluminum substrate and a photosensitive layer provided thereon, the outermost surface of the substrate containing the elements of aluminum, oxygen, and at least one of titanium and zirconium.

Further objects, features and advantages of the present invention will become apparent from the following description of the preferred embodiments with reference to the attached drawings.

DESCRIPTION OF THE PREFERRED EMBODIMENTS

Figure 1:
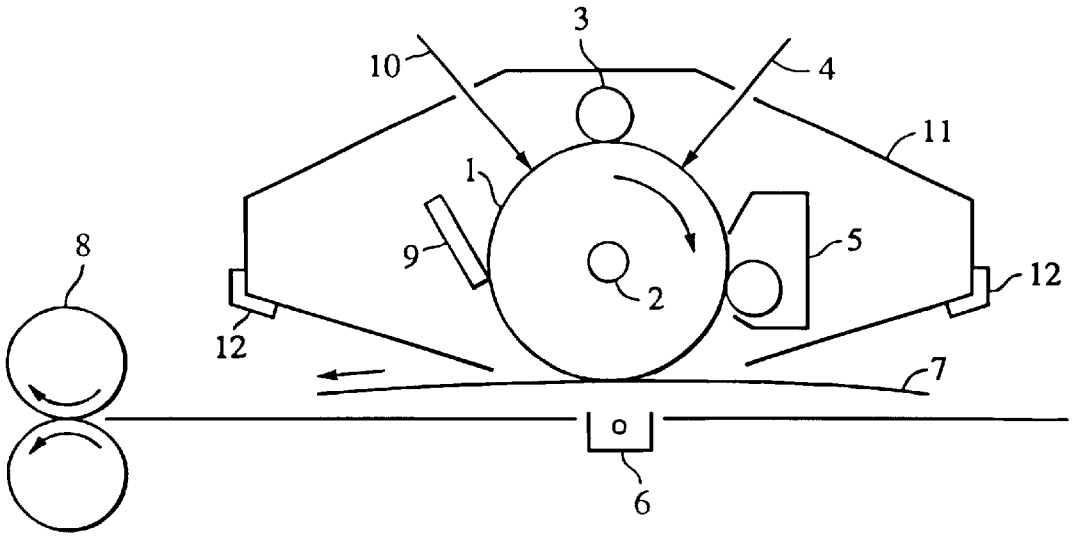
FIG. 1 is a schematic cross-sectional view of an electrophotographic apparatus having a process cartridge of the present invention.

The process cartridge or the electrophotographic apparatus in accordance with the present invention includes an electrophotographic photosensitive member and a charging member for charging the electrophotographic photosensitive member by the application of a voltage, the charging member being in contact with the electrophotographic photosensitive member. The electrophotographic photosensitive member includes an aluminum substrate and a photosensitive layer provided thereon, the outermost surface of the substrate containing the elements of aluminum, oxygen, and at least one of titanium and zirconium.

The aluminum substrate used in the present invention may be prepared by a chemical treatment of an untreated aluminum substrate in an acidic aqueous solution containing a metal salt. The phrase "chemical treatment" in the present invention refers to a treatment for forming a film having a specific composition on a substrate by bringing the substrate into contact with a specific solution, without applying an electrical force, in contrast to anodic oxidation.

Preferred metal salts used in the present invention include titanium salts and zirconium salts. When the aluminum substrate of the electrophotographic photosensitive member has a chemical conversion film composed of aluminum, oxygen and these metal components, the substrate has superior electrophotographic characteristics.

Preferred titanium and zirconium salts are fluorine containing compounds. Examples of titanium salts are titanium hydrofluoric acid, sodium, potassium and ammonium salts thereof, and titanium sulfate. Examples of zirconium salts are zirconium potassium fluoride and zirconium sulfate.

The preferred concentration of the metal salt in the acidic aqueous solution lies in a range of 0.01 to 2 grams per liter. The preferred concentration of the fluoride ions in the acidic aqueous solution lies in a range of 0 to 10 grams per liter. Such a fluoride concentration is suitable for the formation of a uniform film on the substrate by an etching reaction.

The pH of the acidic aqueous solution in the present invention is preferably adjusted to a range of 1.0 to 5.5 using an ammonia solution or a sodium hydroxide solution. A pH of less than 1.0 causes a vigorous etching reaction which inhibits the formation of a satisfactory film, whereas a pH exceeding 5.5 causes a delayed etching reaction which cannot form a film having superior characteristics.

In the present invention, it is preferable to heat the acidic aqueous solution to 30 to 90° C. in order to stabilize the reaction.

Contact of the substrate with the acidic aqueous solution may be performed by a dipping, spraying or an atomizing process. A dipping process is preferred in view of treatment efficiency.

The composition of the substrate surface in the present invention is determined by measuring the 50-Å depth from the top surface of the substrate by Auger electron spectroscopy. The content of titanium or zirconium in the present invention preferably lies in a range of 4 to 100 atomic percent of the aluminum content.

The total thickness of the chemical conversion film containing titanium or zirconium is preferably 1 μm or less, and more preferably 50 Å or more. When the thickness exceeds 1 μm, an increase in residual potential or ghosting will easily occur due to unsuccessful charge releasing. When the thickness is less than 50 Å, superior characteristics of the present invention are not achieved.

The acidic aqueous solution preferably contains a phosphoric acid, a phosphate, a tannin, or a tannic acid in order to improve corrosion resistance and adhesiveness of the coating film.

Examples of phosphoric acids and phosphates include orthophosphoric acid and sodium, potassium and ammonium salts thereof, and polyphosphoric acids, e.g., pyrophosphoric acid, triphosphoric acid and hexaphosphoric acid, and salts thereof with alkaline metals, e.g., sodium and potassium. In the present invention, organic phosphonic acids can also be used. Examples of the phosphonic acids are phytic acid, nitrodiethanolethylenephosphonic acid, 2-hydroxyethylmethacryl-1-acid phosphonic acid, 2-ethylhexyl phosphonate, and ethane-1-hydroxy-1,1-diphosphonic acid.

The concentration of the phosphoric acid or phosphate in the acidic aqueous solution is preferably in a range of 0.05 to 50 grams per liter as a reduced phosphate ion concentration. In such a concentration, the solution is stable and a particularly uniform chemical conversion film is obtainable.

Examples of tannins and tannic acids include quebracho extract, depsides, Chinese tannic acid, Turkish tannic acid, hamamelitannin, chebulinic acid, sumac tannin, Chinese gallotannin, and ellagitannin.

The preferred concentration of the tannin or tannic acid in the acidic aqueous solution is in a range of 0.1 to 10 grams per liter.

The acidic aqueous solution in the present invention preferably contains hydrofluoric acid, borofluoric acid, hydrosilicofluoric acid, and salts thereof. These compounds function as surface etchants for the aluminum substrate during the chemical treatment and facilitate the formation of a significantly uniform chemical conversion film.

Accordingly, the chemical conversion film in accordance with the present invention preferably contains the elements of phosphorus and fluorine.

The substrate subjected to the chemical treatment is cleaned and dried before use.

The aluminum substrate used in the present invention may be composed of pure aluminum or an aluminum alloy, e.g., an Al—Mn, Al—Mg, Al—Cu, Al—Si, Al—Mg—Si or Al—Cu—Si alloy. In particular, Japanese Industrial Standard (JIS) 6000 and 3000 series aluminum alloys, such as JIS A 6063 and A 3003, are preferably used. The aluminum substrate may have any shape and is preferably a drum.

The photosensitive layer of the electrophotographic photosensitive member used in the present invention will now be described.

The configurations of the photosensitive layer in the present invention are classified into a single-layer type containing a charge generating material and a charge transfer material and a composite type having a charge generating layer containing a charge generating material and a charge transport layer containing a charge transfer material.

An electrophotographic photosensitive member having a composite-type photosensitive layer will now be described.

The photosensitive layer has a configuration in which a charge generating layer and a charge transport layer are deposited on the substrate, in that order, or in which a charge transport layer and a charge generating layer are deposited on the substrate, in that order.

The charge transport layer may be formed by applying a solution containing a resin having film formability and a charge transport material, followed by drying. Examples of charge transport materials are polycyclic aromatic compounds, e.g., biphenylene, anthracene, pyrene, and phenanthrene; nitrogen-containing heterocyclic compounds, e.g., indole, carbazole, oxadiazole and pyrazoline; hydrazone compounds; and styryl compounds. Examples of resins having film formability are polyesters, polycarbonates, polystyrenes, polymethacrylate esters and polyarylates. The thickness of the charge transport layer is preferably 5 to 40 μm and more preferably 10 to 30 μm.

The charge generating layer may be formed by applying a solution containing a resin and a charge generating material dispersed therein, followed by drying, or by depositing a pigment in vacuo. Examples of charge generating materials are azo pigments, e.g., Sudan Reds and Dyan Blue; quinone pigments, e.g., pyrene, quinone and anthraquinone; quinocyanine pigments; perylene pigments; indigo pigments, e.g., indigo and thioindigo; phthalocyanine pigments. Examples of resins are polyvinyl butyral, polystyrene, polyvinyl acetate, and acrylic resins. The thickness of the charge generating layer is preferably 5 μm or less, and more preferably 0.01 to 3 μm.

A single-layer photosensitive layer may be prepared by applying a solution containing a resin, a charge generating material and a charge transfer material dissolved or dispersed therein, followed by drying.

The thickness of the photosensitive layer is preferably 5 to 40 μm and more preferably 10 to 30 μm.

In the present invention, an underlying layer having a barrier function and an adhesive function may be provided between the substrate and the photosensitive layer. The underlying layer can be prepared by applying a solution containing casein, polyvinyl alcohol, nitrocellulose, an ethylene-acrylic acid copolymer, an alcohol-soluble polyamide, a polyurethane or gelatin, followed by drying. The thickness of the underlying layer is preferably 0.1 to 3 μm.

In the present invention, a protective layer may be formed. Examples of materials for forming the protective layer include polyesters, polyacrylates, polyethylene, polystyrene, polybutadiene, polycarbonates, polyamides, polypropylene, polyimides, polyamide-imides, polysulfones, polyacrylethers, polyacetal, phenolic resins, acrylic resins, silicone resins, epoxy resins, urea resins, allyl resins, alkyd resins, butyral resins, phenoxy resins, phosphazene resins, acrylic modified epoxy resins, acrylic modified urethane resins and acrylic modified polyester resins. The thickness of the protective layer is preferably 0.2 to 10 μm.

The above-described layers may contain lubricants, e.g., polytetrafluoroethylene, polyvinylidene fluoride, fluorinated graft polymers, silicone graft polymers, fluorinated block polymers, silicone graft polymers and silicone oils, in order to improve cleaning ability and abrasion resistance. These layers may further contain other additives, such as antioxidants for improving weatherability.

In the protective layer, a conductive powder composed of tin oxide or titanium oxide may be dispersed to control the resistance of the layer.

Figure 2:
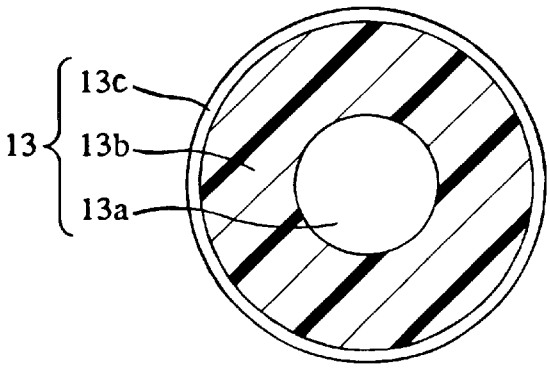
FIG. 2 is a cross-sectional view showing a layer configuration of a charging member in accordance with the present invention.

The charging member used in the present invention may have any shape, such as a roller, a brush, a belt, or a blade. A roller-type charging member is preferable. FIG. 2 shows a roller-type charging member 13.

It is preferable that the charging member 13 have proper elasticity in order to bring the charging member 13 into uniform contact with the surface of the photosensitive member. Thus, the charging member 13 preferably includes a conductive supporting member 13*a,* composed of stainless steel or the like, for applying a voltage, a conductive elastic layer 13*b* composed of rubber or cellular material, and an optional conductive covering layer 13*c,* which is provided on the conductive elastic layer 13*b,* to improve abrasion resistance and to prevent contamination of the surface of the photosensitive member.

Examples of elastic members used in the conductive elastic layer 13*b* are polymers, such as thermoplastic and thermosetting resins, thermoplastic elastomers and rubbers. These polymers may contain conductivity-imparting agents and other additives, if necessary. Examples of thermoplastic and thermosetting resins include polystyrene, polyvinyl chloride, phenolic resins, epoxy resins, polyesters, polypropylene, urethane resins, silicone resins, acrylic resins, polyvinyl alcohol, polyvinyl butyral, and ethylene-vinyl acetate copolymers. Examples of thermoplastic elastomers include olefinic thermoplastic elastomers, fluorinated thermoplastic elastomers and polyester thermoplastic elastomers. Examples of rubbers include natural rubber, isoprene rubber, ethylene-propylene rubber, butyl rubber, butadiene rubber, nitrile rubber, styrene-butadiene rubber, chloroprene rubber, urethane rubber, epichlorohydrin rubber, silicone rubber and fluorinated rubber.

The conductive covering layer 13*c* may be composed of one of the above-mentioned polymers and may optionally contain a conductivity-imparting agent.

Examples of conductivity-imparting agents include carbon black, graphite, metal oxides such as zinc oxide and tin oxide, and conductive polymers such as polypyrrole and polyaniline. Ionic conductors, such as metal salts, can also be used.

The volume resistivity of the charging member is in a range of $10^2$ to $10^{12}$ Ωcm, and more preferably $10^5$ to $10^{10}$ Ωcm.

FIG. 1 shows an outlined configuration of an electrophotographic apparatus provided with a process cartridge having an electrophotographic photosensitive member in accordance with the present invention.

A drum electrophotographic photosensitive member 1 rotates around an axis 2 in the direction of the arrow at a given peripheral speed. The photosensitive member 1 is uniformly charged to a given positive or negative potential by a primary charging means 3, and then is exposed by exposure light 4 from an exposure means (not shown in the drawing), such as a slit exposure unit or a laser beam exposure unit. A latent image is sequentially formed on the photosensitive member 1.

The latent image is developed by a developing means 5 with toner, and the developed toner image is transferred by a transfer means 6 onto a transfer medium 7 which is fed between the photosensitive member 1 and the transfer means 6 from a feeding section (not shown in the drawing) in synchronism with the rotation of the photosensitive member 1.

The transfer member having the transferred image is detached from the photosensitive member, is introduced into an image fixing means 8 to fix the image, and is discharged as a print from the apparatus.

The residual toner on the surface of the photosensitive member, after the image transfer, is removed by a cleaning means 9 and the surface is deelectrified by pre-exposure light 10 from a pre-exposure means (not shown in the drawing) to be used for the next image formation. In the present invention, since the primary charging means 3 is a contact charging means, pre-exposure is not always necessary.

In the present invention, a plurality of units among the electrophotographic photosensitive member 1, the primary charging means 3, the developing means 5 and the cleaning means 9 may be integrally combined as a process cartridge, which is mountable into and detachable from an electrophotographic apparatus body, such as a copying machine or a laser beam printer. For example, at least one of the primary charging means 3, the developing means 5, and the cleaning means 9 is integrally supported with the photosensitive member 1 in a process cartridge 11, which is mountable into the apparatus body by a guide means, such as a rail 12 in the apparatus body.

When the electrophotographic apparatus is a copying machine or a printer, the exposure light 4 is controlled by laser beam scanning or by driving of an LED array or liquid crystal shutter array in response to signals which are formed by conversion of the information from a document read by a sensor.

The electrophotographic photosensitive member in accordance with the present invention can be widely used in electrophotographic applications, such as laser beam printers, CRT printers, LED printers, liquid crystal printers and laser engraving processes, in addition to electrophotographic copying machines.

EXAMPLE 1

A aluminum cylinder having an outer diameter of 29.92 mm, an inner diameter of 28.5 mm and a length of 254 mm was prepared.

An acidic aqueous solution (Trade name: PALCOAT 3753 made by Nihon Perkerizing Company Limited, pH: 3.8) containing phytic acid as an organic phosphoric acid, titanium hydrofluoric acid, and titanium ammonium fluoride was maintained at 45° C. The aluminum cylinder was dipped into the solution for 2 minutes to perform chemical treatment, was washed with deionized water, and was dried in air. The thickness of the resulting chemical conversion film was 250 Å.

Next, 4 parts by weight of oxytitanium phthalocyanine pigment, 2.2 parts by weight of polyvinyl butyral (Trade Name: BX-1 made by Sekisui Chemical Co., Ltd.), and 40 parts by weight of cyclohexanone were dispersed in a sand mill for 10 hours, and then 60 parts by weight of tetrahydrofuran was added thereto to prepare a dispersion for a charge generating layer.

The dispersion was applied onto the treated aluminum cylinder by dipping, and then was dried at 95° C. for 10 minutes to form a charge generating layer having a thickness of 0.2 $\mu$m.

Next, a solution of 50 parts by weight of triarylamine compound represented by the following formula and 50 parts by weight of bisphenol-Z type polycarbonate resin dissolved in 400 parts by weight of monochlorobenzene was dip-coated on the charge generating layer, and was dried at 100° C. for 1 hour to form a charge transport layer having a thickness of 22 $\mu$m.

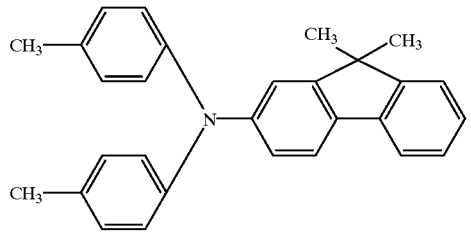

Then, 70 parts by weight of styrene-butadiene elastomer and 30 parts by weight of polypropylene were blended at 180° C. for 5 minutes, and then 10 parts by weight of carbon black was added. The mixture was kneaded in a pressurized kneader at 180° C. for 10 minutes. The blend was cooled and pelletized. A seamless tube having an inner diameter of 12.5 mm and a thickness of approximately 150 $\mu$m was formed of the pellets using a twin-screw extruder.

A conductive rubber compound was prepared by blending 100 parts by weight of ethylene-propylene rubber, 15 parts by weight of conductive carbon black, 50 parts by weight of paraffin oil, a foaming agent, a vulcanizer, and other additives. The blend was molded around a stainless steel core bar with a diameter of 6 mm and a length of 254 mm and then vulcanized to form a conductive rubber roller including a cellular layer with a thickness of 4.5 mm.

Air was blown into the seamless tube to expand the inner diameter of the tube to 15.5 mm and the conductive rubber roller was inserted therein to form a charging member. The resulting charging member had a volume resistivity of $2\times10^5$ Ωcm.

(Evaluation)

The aluminum substrate, which had been chemically treated, washed and dried, was subjected to elemental analysis by scanning Auger electron spectroscopy to measure the depth profile of the substrate surface by argon ion etching. The detected major components were aluminum, titanium and oxygen.

Table 1 shows the results of the elemental analysis at the outermost surface and at the depth of 50 Å from the surface, in which each component is represented by the atomic ratio to the content, 100, of the aluminum atoms.

The results show that the chemical conversion film on the aluminum substrate surface contains aluminum oxide and includes titanium. The analytical results also show the chemical conversion film contains nitrogen, fluorine and phosphorus, which would be derived from phosphoric acid and the fluorine compound contained in the acidic aqueous solution used in the chemical conversion treatment.

The electrophotographic photosensitive member and the charging member were assembled into a printer cartridge and evaluated using a reversal development type printer. These were allowed to stand in the environments for evaluation, that is, a normal-temperature and normal-humidity environment (23° C., 60% Rh), a high-temperature and high-humidity environment (32.5° C., 85% Rh), and a low-temperature and low-humidity environment (15° C., 10% Rh), for 48 hours each. The solid image by visual observation, the dark-part potential, and the light-part potential were measured. The results are shown in Table 2.

EXAMPLE 2

An electrophotographic photosensitive member was prepared and evaluated as in EXAMPLE 1, using an acidic aqueous solution for chemical conversion treatment (Trade name: PALCOAT 3756 made by Nihon Perkerizing Company Limited, pH: 3.2), which contained tannic acid, zirconium fluoride, and zirconium sulfate, instead of PALCOAT 3753. The thickness of the chemical conversion film was 180 Å. The results are shown in Tables 1 and 2.

EXAMPLE 3

An electrophotographic photosensitive member was prepared and evaluated as in EXAMPLE 1, using an acidic aqueous solution for chemical conversion treatment (Trade name: PALCOAT 3753T made by Nihon Perkerizing Company Limited, pH: 3.5), which contained phytic acid, zirconium hydrofluoric acid, and ammonium zirconium fluoride, instead of PALCOAT 3753. The thickness of the chemical conversion film was 220 Å. The results are shown in Tables 1 and 2.

EXAMPLE 4

An electrophotographic photosensitive member was evaluated as in EXAMPLE 1, using a charging member having a volume resistivity of $1\times10^4$ Ωcm. The results are shown in Table 2.

Comparative Example 1

An electrophotographic photosensitive member was evaluated as in EXAMPLE 1, but chemical treatment was not performed. The results are shown in Table 2.

Comparative Example 2

A 0.3% aqueous ammonia solution was heated to 95° C. and the untreated aluminum cylinder prepared as in EXAMPLE 1 was dipped into the solution for 5 minutes to form a boehmite film.

An electrophotographic photosensitive member was prepared and evaluated as in EXAMPLE 1, using this aluminum cylinder provided with the boehmite film instead of that in EXAMPLE 1. The results are shown in Table 2.

Comparative Example 3

An aluminum cylinder was dipped into a chromium phosphate based chemical conversion solution not containing titanium and zirconium (Trade name: ALUCHROME 3701 made by Nihon Perkerizing Company Limited) at 30° C. for 1 minute, instead of the acidic aqueous solution of the present invention, to form a chromate-based chemical conversion film on the surface.

An electrophotographic photosensitive member was prepared and evaluated as in EXAMPLE 1 using this aluminum cylinder instead of that in EXAMPLE 1. The results are shown in Table 2.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 1

| | | Abundance of Elements Relative to Aluminum (atomic percent) | | | | | | | |
|---|---|---|---|---|---|---|---|---|---|
| | Location | Al | Ti | Zr | O | N | F | P | C |
| EXAMPLE 1 | Outermost | 100 | 34.5 | — | 475 | 75.3 | 8.3 | 15.1 | 515.9 |
| | at 50 Å | 100 | 70.8 | — | 430.5 | 48.3 | 7.1 | 12.4 | — |
| EXAMPLE 2 | Outermost | 100 | — | 25.7 | 438.2 | — | 9.8 | 32.9 | 506.8 |
| | at 50 Å | 100 | — | 22.1 | 230 | — | 7.7 | 11.2 | — |
| EXAMPLE 3 | Outermost | 100 | — | 30.2 | 358.2 | 55.6 | 7.2 | — | 446.8 |
| | at 50 Å | 100 | — | 58.3 | 337.7 | 41.8 | 6.3 | — | — |

Instrument: Scanning Auger Electron Spectrometer, type 670xi, made by ULVAC-PHI, INC. Diameter of electron probe: 0.1 μm or less. An argon ion gun was used for etching.

TABLE 2

| | Fogging | | | Observed Potential (-V) | | | | | |
|---|---|---|---|---|---|---|---|---|---|
| | | | | Normal T-H | | High T-H | | Low T-H | |
| | Normal T-H | High T-H | Low T-H | Dark Part | Light part | Dark Part | Light part | Dark Part | Light part |
| EXAMPLE 1 | E | E | E | 700 | 180 | 700 | 175 | 700 | 185 |
| EXAMPLE 2 | E | E | E | 700 | 185 | 700 | 185 | 700 | 190 |
| EXAMPLE 3 | E | E | E | 695 | 175 | 695 | 170 | 700 | 180 |
| EXAMPLE 4 | E | E | E | 695 | 180 | 695 | 170 | 695 | 180 |
| COMPARATIVE EXAMPLE 1 | NG | NG | NG | 670 | 170 | 665 | 160 | 670 | 230 |
| COMPARATIVE EXAMPLE 2 | NG | NG | NG | 680 | 195 | 670 | 180 | 685 | 205 |
| COMPARATIVE EXAMPLE 3 | NG | NG | NG | 680 | 180 | 675 | 170 | 685 | 195 |

TABLE 2-continued

| | | | Observed Potential (-V) | | | | | |
|---|---|---|---|---|---|---|---|---|
| Fogging | | | Normal T-H | | High T-H | | Low T-H | |
| Normal T-H | High T-H | Low T-H | Dark Part | Light part | Dark Part | Light part | Dark Part | Light part |

Normal T-H: Normal temperature & humidity, High T-H: High temperature & humidity, Low T-H: Low temperature & Humidity
Evaluation of Fogging: E for excellent, NG for not good

What is claimed is:

1. A process cartridge comprising:

an electrophotographic photosensitive member; and a charging member for charging the electrophotographic photosensitive member by the application of a voltage, the charging member being in contact with the electrophotographic photosensitive member, the electrophotographic photosensitive member and the charging member being integrally supported and being mountable to and detachable from an electrophotographic apparatus body;

wherein the electrophotographic photosensitive member comprises an aluminum substrate and a photosensitive layer provided thereon, the outermost surface of the substrate containing the elements of aluminum, oxygen, and at least one of titanium and zirconium, formed by chemical treatment without anodizing.

2. A process cartridge according to claim 1, wherein the content of said at least one element of titanium and zirconium at the outermost surface is in a range of 4 to 100 atomic percent of the aluminum element content.

3. A process cartridge according to claim 1, wherein the outermost surface further contains the element phosphorus.

4. A process cartridge according to either claim 1 or 3, wherein the outermost surface further contains the element fluorine.

5. A process cartridge according to claim 1, wherein the outermost surface of the aluminum substrate comprises a chemical conversion film formed by a chemical treatment.

6. A process cartridge according to claim 5, wherein the chemical conversion film has a thickness of not more than 1 $\mu$m.

7. A process cartridge according to claim 1, wherein the charging member comprises a conductive supporting member, an elastic layer formed on the conductive supporting member, and a covering layer formed on the elastic layer.

8. An electrophotographic apparatus comprising: an electrophotographic photosensitive member, a charging member for charging the electrophotographic photosensitive member by the application of a voltage, the charging member being in contact with the electrophotographic photosensitive member, an exposure means, a developing means, and a transfer means;

wherein the electrophotographic photosensitive member comprises an aluminum substrate and a photosensitive layer provided thereon, the outermost surface of the substrate containing the elements of aluminum, oxygen, and at least one of titanium and zirconium, formed by chemical treatment without anodizing.

9. An electrophotographic apparatus according to claim 8, wherein the content of said at least one element of titanium and zirconium at the outermost surface is in a range of 4 to 100 atomic percent of the aluminum element content.

10. An electrophotographic apparatus according to claim 8, wherein the outermost surface further contains the element phosphorus.

11. An electrophotographic apparatus according to either claim 8 or 10, wherein the outermost surface further contains the element fluorine.

12. An electrophotographic apparatus according to claim 8, wherein the outermost surface of the aluminum substrate comprises a chemical conversion film formed by a chemical treatment.

13. An electrophotographic apparatus according to claim 12, wherein the chemical conversion film has a thickness of not more than 1 $\mu$m.

14. An electrophotographic apparatus according to claim 8, wherein the charging member comprises a conductive supporting member, an elastic layer formed on the conductive supporting member, and a covering layer formed on the elastic layer.

* * * * *

UNITED STATES PATENT AND TRADEMARK OFFICE

CERTIFICATE OF CORRECTION

PATENT NO. : 6,400,916 B1
DATED : June 4, 2002
INVENTOR(S) : Shintetsu Go et al.

It is certified that error appears in the above-identified patent and that said Letters Patent is hereby corrected as shown below:

Column 2,
Line 11, “dispose” should read -- dispose of --.

Column 5,
Line 13, “polyarylates” should read -- polyarcrylates. --.
Line 20, “Dyan” should read -- Cyan --.
Line 51, “hazene” should read -- hazine --.

Column 7,
Line 36, “A” should read -- An --.

Signed and Sealed this

Eighteenth Day of March, 2003

JAMES E. ROGAN
*Director of the United States Patent and Trademark Office*